US009849665B2

(12) United States Patent
Livingston

(10) Patent No.: US 9,849,665 B2
(45) Date of Patent: Dec. 26, 2017

(54) HEAT PRESSABLE PLATEN

(71) Applicant: Livingston Systems, LLC, Northglenn, CO (US)

(72) Inventor: Darren Livingston, Denver, CO (US)

(73) Assignee: Livingston Systems, LLC, Northglenn, CO (US)

( * ) Notice: Subject to any disclaimer, the term of this patent is extended or adjusted under 35 U.S.C. 154(b) by 0 days.

(21) Appl. No.: 14/959,657

(22) Filed: Dec. 4, 2015

(65) Prior Publication Data

US 2016/0159075 A1 Jun. 9, 2016

Related U.S. Application Data

(60) Provisional application No. 62/088,123, filed on Dec. 5, 2014.

(51) Int. Cl.

| | |
|---|---|
| ***B41F 16/02*** | (2006.01) |
| ***B41F 17/38*** | (2006.01) |
| ***B41F 17/00*** | (2006.01) |
| ***D06F 71/40*** | (2006.01) |

(52) U.S. Cl.

CPC ..... *B41F 17/005* (2013.01); *B41F 16/02* (2013.01); *B41F 17/38* (2013.01); *D06F 71/40* (2013.01)

(58) Field of Classification Search

CPC ..... D06F 71/20; D06F 71/40; B41F 15/18; B41F 15/16; B41F 17/38; B41F 17/005; B41F 16/02; B41J 3/4078

USPC ..... 101/115, 126, 474; 223/120; 156/583.1

See application file for complete search history.

(56) References Cited

U.S. PATENT DOCUMENTS

| | | | | |
|---|---|---|---|---|
| 6,631,985 | B2 * | 10/2003 | Koizumi | B41J 2/2114 347/101 |
| 2005/0278984 | A1 * | 12/2005 | Kenney | B41F 16/02 38/17 |
| 2013/0057632 | A1 * | 3/2013 | Moriya | B41J 3/4078 347/104 |
| 2013/0336702 | A1 * | 12/2013 | Yanagishita | B41J 15/16 400/618 |

OTHER PUBLICATIONS

Screenshots of website (http://littlesistersystem.com/) and corresponding videos linked from this website. Videos uploaded Feb. 18, 2013 and May 25, 2009, respectively, 3 pages total.

* cited by examiner

*Primary Examiner* — Leslie J Evanisko

(74) *Attorney, Agent, or Firm* — Trenner Law Firm, LLC; Mark D. Trenner

(57) ABSTRACT

A platen is disclosed. In an example, the platen may include a shirtboard configured to receive a garment. A backing is coupled to the shirtboard. The backing and the shirtboard are compressible to selectively compress the shirtboard against the backing during a printing operation. An example method of printing on a garment includes threading a garment onto a board so that the board is wearing the garment, supporting the board against a backing during compression, and printing on the garment. In an example, a fabric of the garment is pretreated, heat-pressed, and printed on, all without removing the garment from the board.

11 Claims, 6 Drawing Sheets

HEAT PRESSABLE PLATEN

PRIORITY CLAIM

This application claims the priority benefit of U.S. Provisional Patent Application No. 62/088,123 titled "Heat Pressable Platen" of Darren Livingston filed on Dec. 5, 2014, hereby incorporated by reference for all that is disclosed as though fully set forth herein.

BACKGROUND

A platen is often used for direct to garment textile printing (e.g., to print lettering and/or design on t-shirts and other garments). The garment may be placed on the platen for a variety of printing operations. Depending on the printing operation, an operator may need to use more than one different platen during the printing operation. For example, the operator may first need to use a pretreatment platen for pretreating the garment fabric. The operator may then need to use a heat press platen for heat pressing the garment. Then the operator may need to use a printing platen for printing on the garment, followed by a final curing heat press operation.

Not only does the operator have to use multiple different types of platens, but the operator also has to handle the garment and platen during each of the various printing stages. For example, a garment may need to be placed on and aligned on each of the different platens during the printing process. Having to load, stretch, and then repeat this process for each of the various platens increases the time required for the printing operations.

DETAILED DESCRIPTION

Figure 1A:
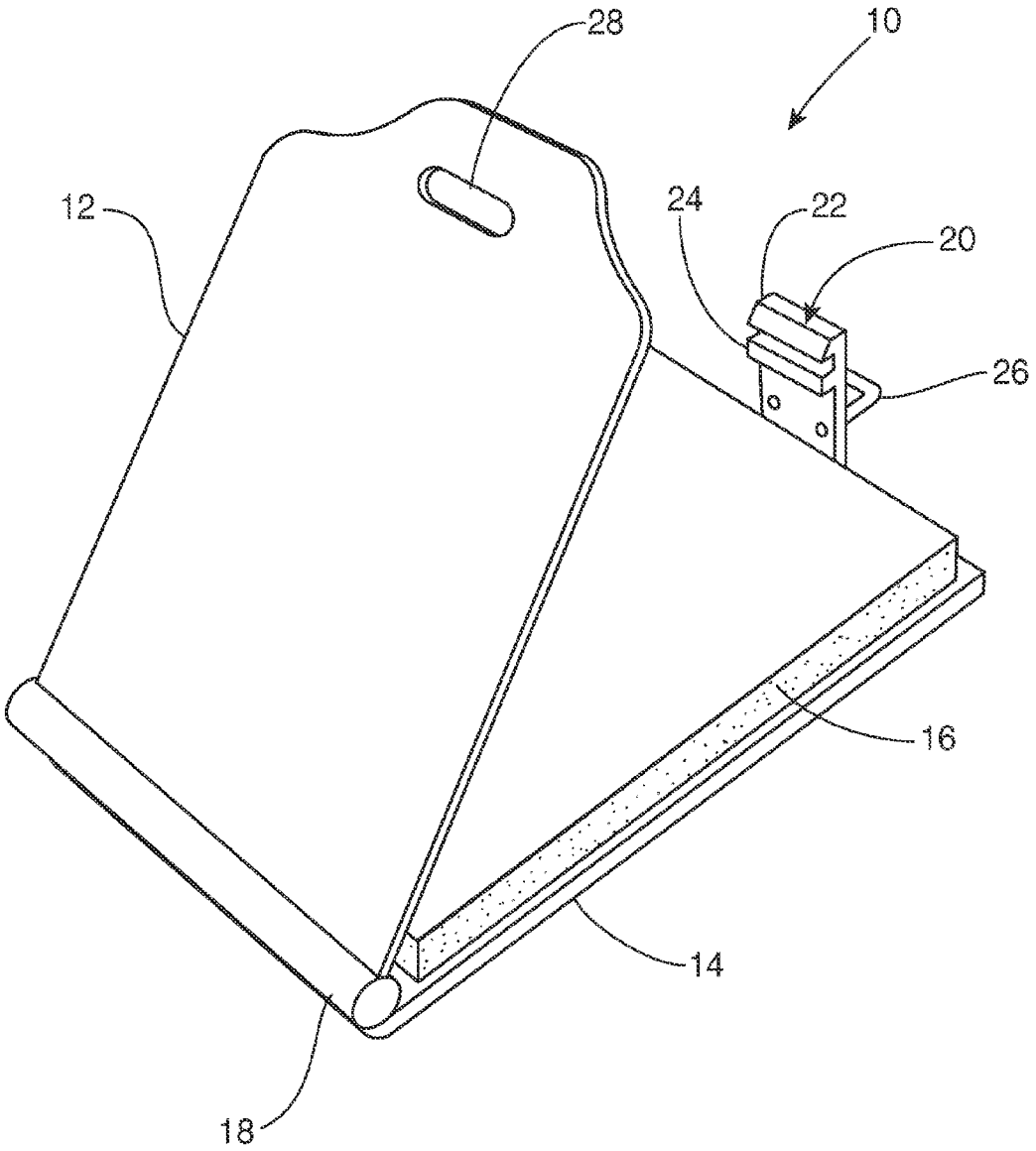
FIGS. 1A-1B are perspective views of an example hinged heat pressable platen.

Direct to garment printing can be used to print lettering and/or design on a garment, such as but not limited to a t-shirt or other shirt. In an example, the garment is positioned on a platen, the garment is sprayed with a pretreatment solution and then placed onto a heat press to cure the pretreatment (e.g., for about 30 seconds at about 300 degrees Fahrenheit, at pressures of about 500-800 lbf). The garment is then removed and placed on a direct to garment printer for printing, and then the garment is placed on a heat press to cure the ink (e.g., for about 60 seconds at about 350 degrees Fahrenheit at about 500-800 lbf). This process involves moving the shirt from station to station.

Previously, the technique required placing the garment on a platen, then removing the garment from the platen and placing the garment on another platen for each station. In addition to needing to have multiple platens, one for each station, which also requires more handling time, the shirt may move and become misaligned for printing, and the artwork may become smeared by contact with the operator.

A heat pressable platen is described herein which eliminates the need to transfer the garment from the platen at any point during the printing process. That is, the same platen is used for each station, thereby reducing the number of platens needed for a print operation, reducing operator handling and total print time, decreasing the risk of damage to the shirt during the printing operation, and reducing or altogether eliminating the risk of misalignment of the area of the shirt which was pre-treated and the area of the shirt to be printed on.

In an example, the heat pressable platen "wears" the garment so that only one layer of material is above the printing surface. The platen is sufficiently thin to fit into most standard heat press units. The garment is held in place during transfer from each station (e.g., from pretreatment to heat press to print and back to the heat press), without having to remove the shirt from the platen. The platen is configured to withstand the extreme force applied during the heat pressing process. The platen also enables the user to load a shirt onto a single platen that follows the shirt through the entire process, thereby eliminating excess handling and the risk of misalignment. The heat pressable platen may be used with, but is not limited to implementation with, the TucLoc™, T Grip™, and Tag Along™ systems.

Before continuing, it should be noted that the examples described above are provided for purposes of illustration, and are not intended to be limiting. Other devices and/or device configurations may be utilized to carry out the operations described herein.

It is further noted that as used herein, the terms "includes" and "including" mean, but is not limited to, "includes" or "including" and "includes at least" or "including at least." The term "based on" means "based on" and "based at least in part on." Although the term "shirt" and "shirtboard" are used herein, the platen is not limited to use with shirts, and may be used with any substrate. In addition, the platen is not limited to use with heat pressing, and may also be implemented for other applications.

Figure 1B:
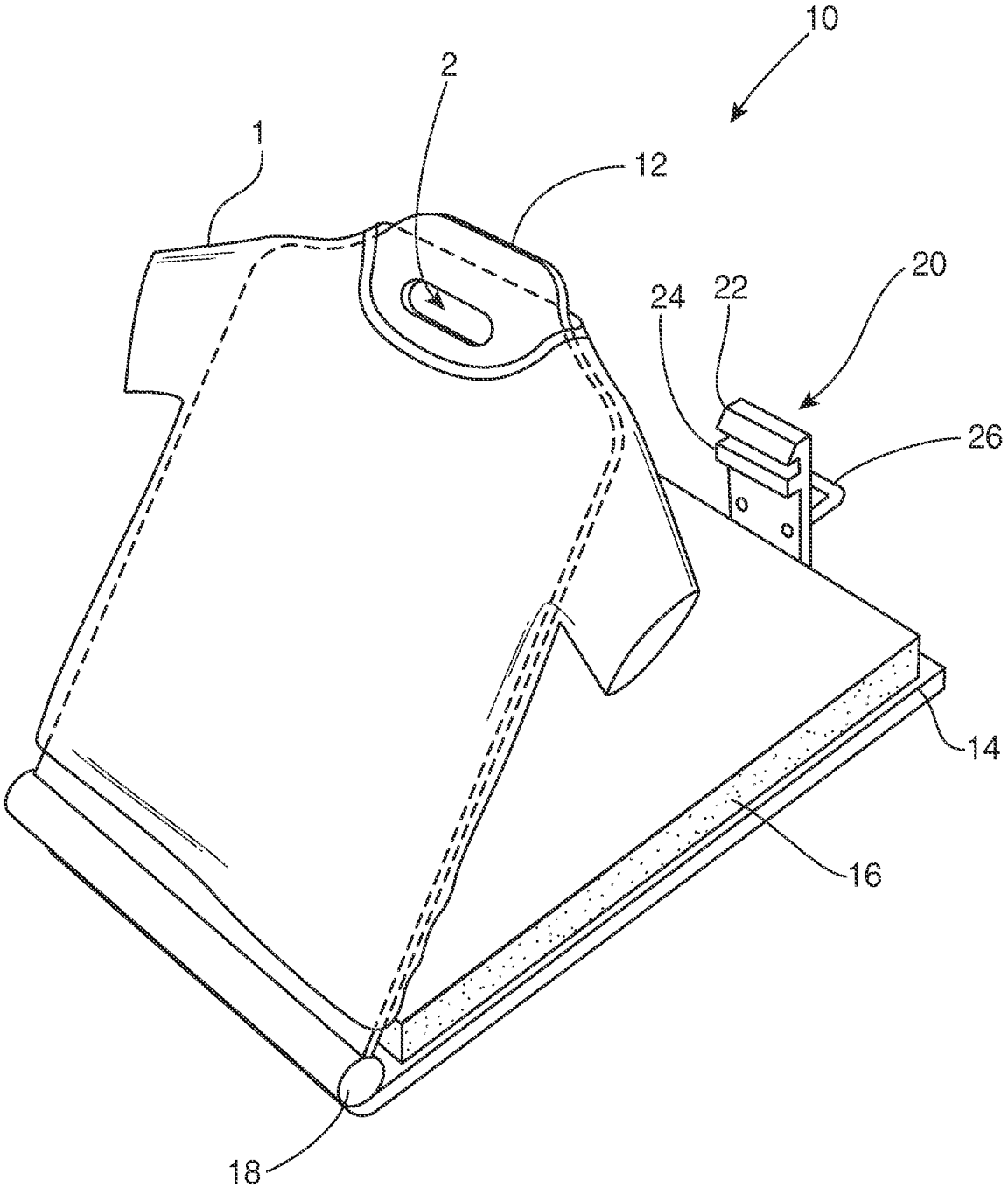

FIGS. 1A-1B are perspective views of an example hinged heat pressable platen. The hinged heat pressable platen 10 is illustrated in an open position in FIGS. 1A-1B; and with a garment to be printed on in FIG. 1B, The platen 10 is shown as it may include a shirtboard 12, and a backboard or backing 14. In an example, the backing 14 may include a cushioned surface 16. For example, the cushioned surface 16 may include dense foam, rubber, or any other material having similar still, yet compressible and resilient, properties.

In an example, backing 14 may be rotatably coupled to the shirtboard 12. For example, the backing 14 may be hinged to the shirtboard 12. In FIGS. 1A and 1B, the backing 14 is shown rotatably coupled to the shirtboard 12 by a hinge 18 at the "waist-end" of the shirtboard 12 (e.g., where the waist-end of a garment is positioned on the shirtboard 12). The hinge 18 may be positioned between the shirtboard 12 and the backing 14.

When the shirtboard 12 is closed against the cushioned surface 16 (not shown), the shirtboard 12 is substantially parallel to the backing 14 and lays flat against the cushioned surface 16. As such, when the platen 10 is placed in a heat press with the garment 1, the shirt is supported even as the platen 10 is compressed by the heat press during a printing operation.

In an example, a latching mechanism 20 selectively retains the shirtboard 12 against the backing 14 in a closed position. The latching mechanism 20 may include a catch 22. The catch 22 may be slanted to enable the shirtboard 12 to bias the latching mechanism 20 outward as the shirtboard 12 is pressed closed against the backing 14. The latching mechanism 20 may also include a support lip 24 against which the shirtboard 12 is pressed between the catch and support lip 24 when in a closed position. The latching mechanism 20 may also include a release handle 26. The release handle may be pulled outward to release the latching mechanism 20 so that the shirtboard 12 can be moved to an open position.

While an example latching mechanism 20 is shown herein, it is noted that the platen 10 may be implemented with any suitable latching mechanism and is not limited to the example shown in FIG. 1.

In an example, the platen may include a cut-out 28 (e.g., an opening formed through the shirtboard). The cut-out 28 may be provided to enable printing on the inside portion of the garment 1. For example, the cut-out 28 may be provided in the collar area of a shirt such that the cut-out enables printing a tag or label on the inside shirt collar of the shirt. A tag printing cut-out enables separate printing of a label (e.g., a t-shirt tag) so that the label can be printed directly on the inside of the back collar or shirt neck without having to remove the shirt from the platen for a separate printing operation.

Figure 2:
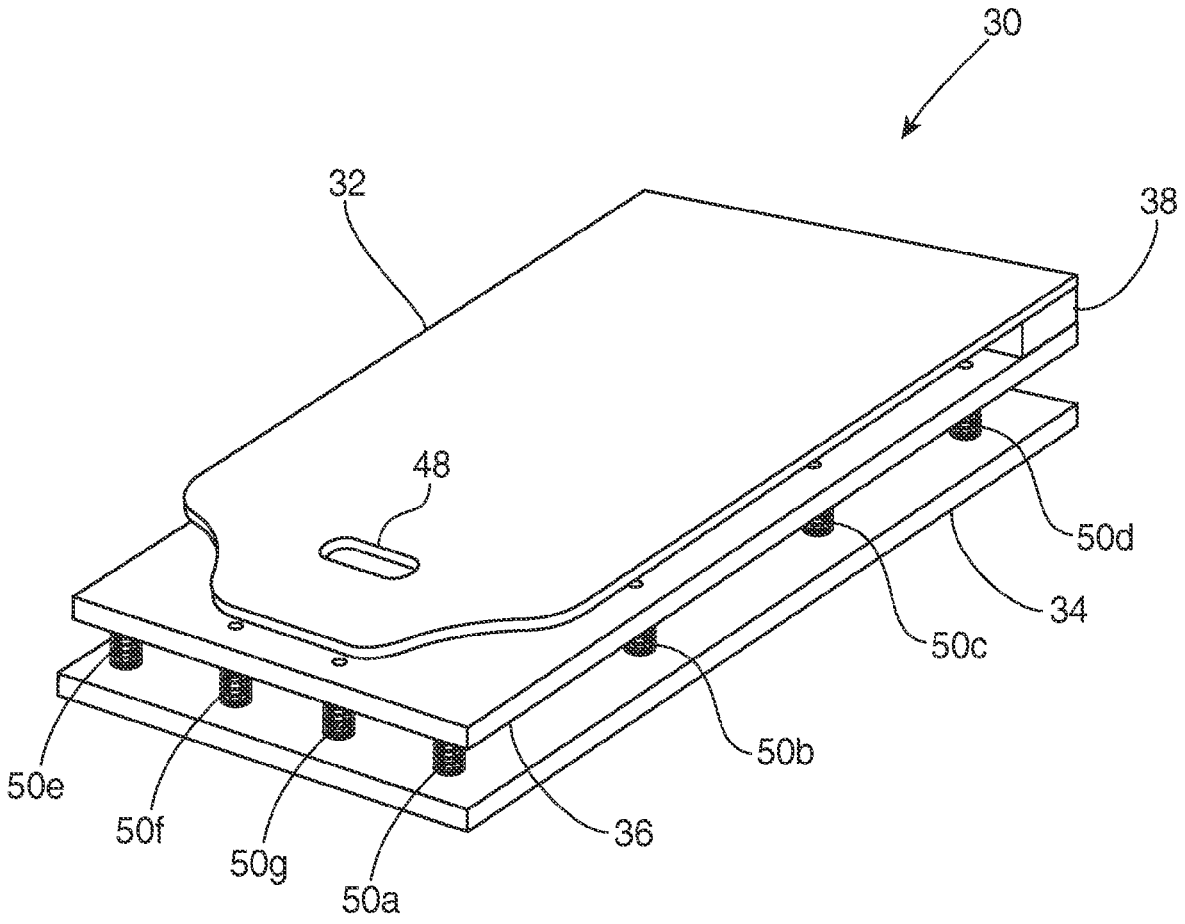
FIG. 2 is a perspective view of another example heat pressable platen.
Figure 3A:
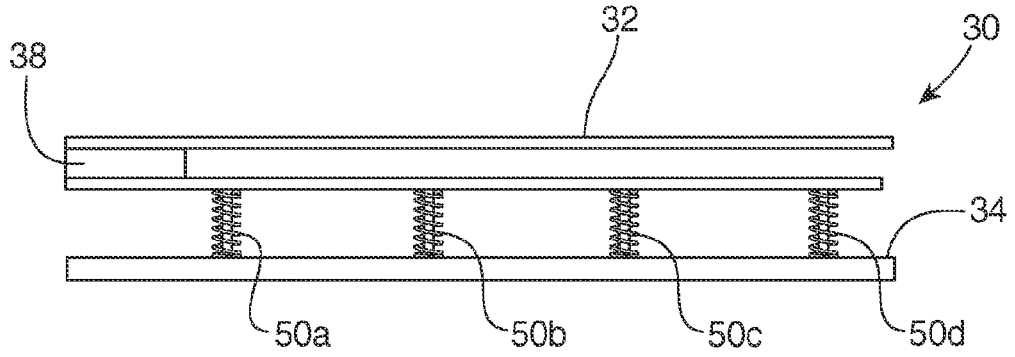
FIGS. 3A-B are side views of the example heat pressable platen shown in FIG. 2.
Figure 3B:
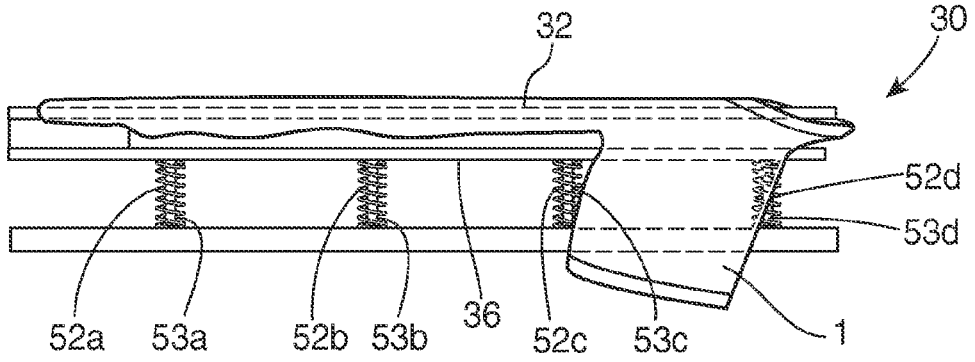

FIG. 2 is a perspective view of another example heat pressable platen 30. FIGS. 3A-B are side views of the example heat pressable platen 30 shown in FIG. 2. In an example, the platen 30 may include a shirtboard 32 and a backboard or backing 34. In an example, a spring board 36 may be coupled to the backing 34. In an example, spring board 36 may be coupled to the shirtboard 32 by a separator 38. In an example, the backing 34 is coupled to the shirtboard 32 by the separator 38 at the "waist-end" of the shirtboard 32, where the waist-end of a garment is positioned on the shirtboard 32.

The separator 38 may be positioned between the shirtboard 32 and the springboard 36, such that the shirtboard 32 is substantially parallel to the backing 34 and is separated from the spring board 36 to enable mounting of a garment therebetween, as illustrated in FIG. 3B.

The spring board 36 may be mounted to the backing 34 by at least one support. In the example, the supports may be configured between the backing 34 and the spring board 36 as an array (e.g., 4 rows of 4 supports are shown in each row in FIG. 2, although only supports 50*a-g* are visible). However, the supports may be provided in any suitable configuration, and there may be fewer or more supports.

In an example, the supports may be spring loaded pins. The spring loaded pins may include springs 52*a-d* over pins 53*a-d*, as shown in FIG. 3B. The pins 53*a-d* are fixed in length. The springs 52*a-d* can be compressed and decompressed. The pins 53*a-d* are fixedly mounted to the backing 34, and mounted through openings formed in the spring board 36. As such, the spring board 36 can be pressed down toward the backing 34 against the bias of the springs 52*a-d*, as may occur when the platen 30 is placed in a heat press. During compression, the pins 53*a-d* extend through the spring board 36, and enable the spring board 36 to move up and down without shifting sideways in position relative to the backing 34.

Figure 4:
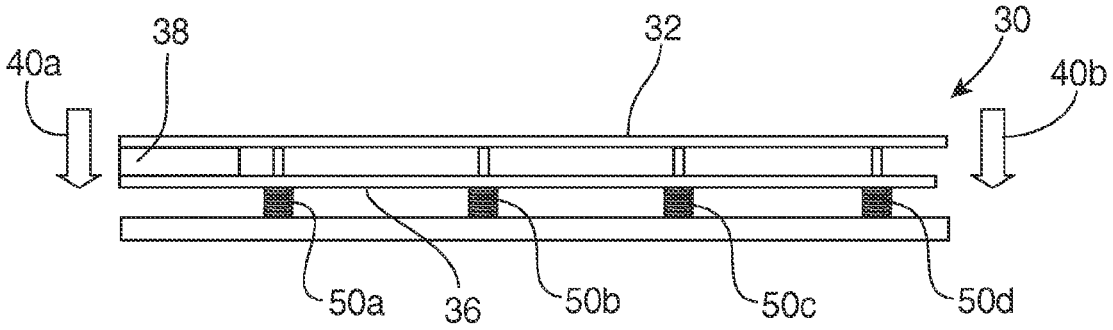
FIG. 4 is another side view of the example heat pressable platen shown in FIG. 2 in a compressed position.

During operation, the springs 52*a-d* bias the spring board 36 in a raised position away from the backing 34. As such, the pins 53*a-d* do not interfere with loading a garment on the shirtboard 32. During a heat press operation (i.e., when the platen 30 is loaded into a heat press, and the heat press is lowered onto the platen 30), the pressure on the shirtboard 32 (e.g., as illustrated in FIG. 4 by arrows 40*a-b*) compresses the springs 52*a-d* such that the pins 53*a-d* extend through the springboard 36 and enable the shirtboard 32 and springboard 36 to move toward the backing 34. Upon full compression, the pins 53*a-d* contact the shirtboard 32 as can be seen in FIG. 4, and support the shirtboard 32. Following the heat press operation, when the upper portion of the heat press is raised from the platen 30, the springs 52*a-d* raise the spring board 36 (e.g., in a direction opposite arrows 40*a-b* in FIG. 4) and return the spring board 36 to an uncompressed position (e.g., as shown in FIGS. 3A-3B).

While an example of supports is shown herein for purposes of illustration, it is noted that the platen 30 may be implemented with any suitable supports and is not limited to the example spring loaded pins shown in the Figures. Other types and/or arrangement of supports may be provided, as will be readily understood by those having ordinary skill in the art after becoming familiar with the teachings herein.

In an example, the platen 30 may include a cut-out 48 (e.g., an opening formed through the shirtboard). The cut-out 48 may be provided to enable printing on the inside portion of the garment 1. For example, the cut-out 48 may be provided in the collar area of a shirt such that the cut-out enables printing a tag or label on the inside shirt collar of the shirt. A tag printing cut-out enables separate printing of a label (e.g., a t-shirt tag) so that the label can be printed directly on the inside of the back collar or shirt neck without having to remove the shirt from the platen for a separate printing operation.

Before continuing, it should be noted that the examples described above are provided for purposes of illustration, and are not intended to be limiting. Other devices and/or device configurations may be utilized to carry out the operations described herein.

Figure 5A:
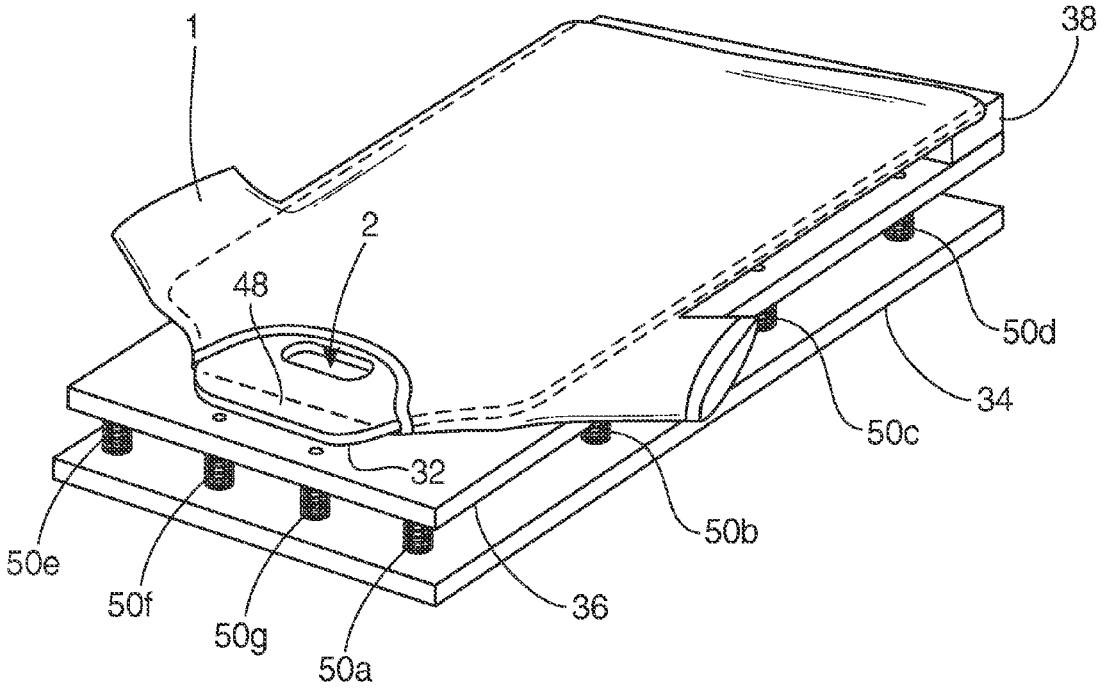
FIG. 5A is a perspective view of the example heat pressable platen shown in FIG. 2 illustrated with a garment.

FIG. 5A is a perspective view of the example heat pressable platen 30 shown in FIG. 2, illustrated with a garment 1. During operation, the garment 1 is mounted to the shirtboard 32 of the platen 30, and may be stretched to provide a flat printing surface.

Figure 5B:
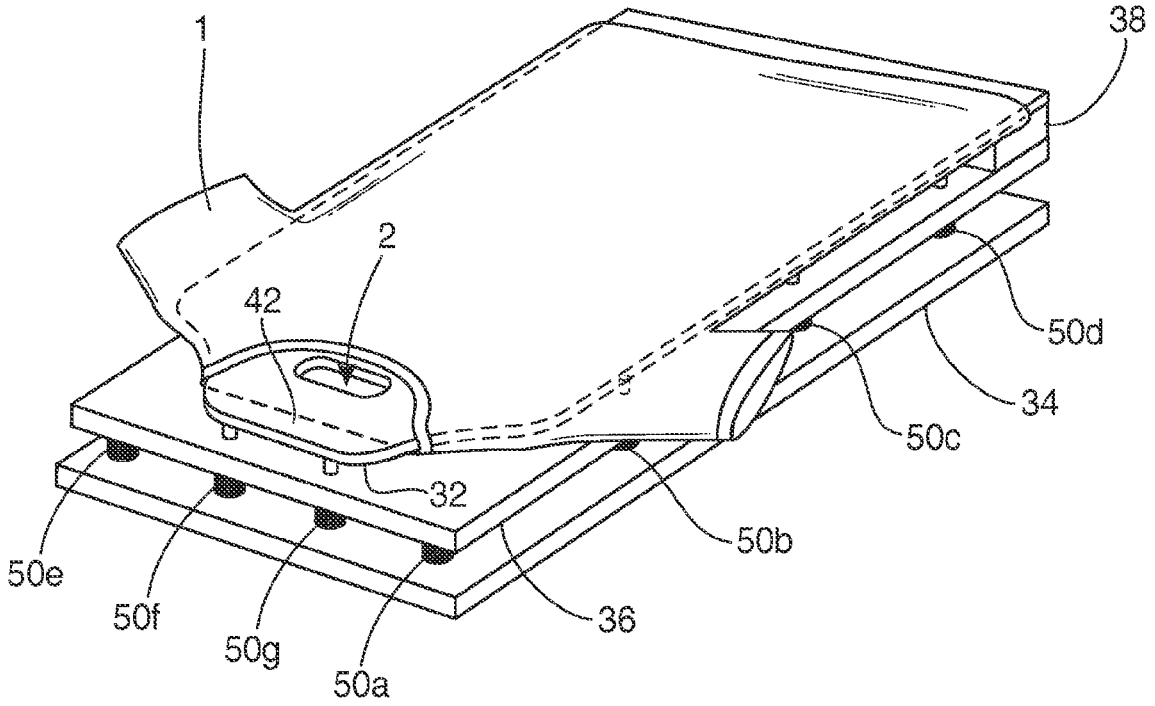
FIG. 5B is a perspective view of the example heat pressable platen illustrated with a garment in a compressed position.

FIG. 5B is a perspective view of the example heat pressable platen 30 illustrated with a garment in a compressed position. The platen 30 may be moved to different stations for the printing operation. When moved to the heat press, the shirtboard 32 of the platen 30 compresses against the pins 53*a-g* as the spring board 36 floats between the shirtboard 32 and backing 34. The springboard 36 supports a flat and rigid printing surface of the garment, even during compression.

A method of printing on a garment includes threading the garment 1 onto a board (e.g., a shirtboard) so that the board is wearing the garment. In an example operation the shirtboard is cantilevered to temporarily move and enable unobstructed threading of a garment on the shirtboard. In this example, the platen includes a swing away shirtboard that enables unimpeded loading of a garment, and rotates into a locked position to support the shirtboard under compression during a heat pressing operation.

In another example, the shirtboard is supported by spring loaded pins that drop away for loading, and support compression for heat pressing.

In an example, the printing operation includes first pre-treating a fabric of the garment on the board, then heat-pressing the fabric of the garment on the board, and then printing on the garment. Pre-treating, heat-pressing, and printing is all performed without removing the garment from the board.

In an example, the method may also include printing a label or "tag" on the inside of a back portion of the garment (e.g., inside the shirt collar 2) via a tag printing cut-out of the platen. The tag printing cut-out enables separate printing of a label (e.g., a t-shirt tag) so that the label can be printed directly on the inside of the back collar or shirt neck without having to remove the shirt from the platen for separate printing.

The operations shown and described herein are provided to illustrate example implementations. It is noted that the operations are not limited to the ordering shown. Still other operations may also be implemented. In addition, the operations are illustrated in FIGS. 5A-5B with reference to the platen 30 shown in FIG. 2. However, similar operations may also be implemented with the platen 10 shown in FIG. 1 and/or other embodiments of the platen 10, as will be readily understood by those having ordinary skill in the art after becoming familiar with the teachings herein.

It is noted that the examples shown and described are provided for purposes of illustration and are not intended to be limiting. Still other examples are also contemplated.

The invention claimed is:

1. A platen comprising:

a shirtboard configured to receive a garment;

a springboard coupled to the shirtboard with a fixed spacing therebetween;

a backing coupled to the shirtboard via the springboard, wherein the springboard is positioned between the shirtboard and the backing;

wherein the backing and the shirtboard are compressible to selectively compress the shirtboard against the backing during a printing operation.

2. The platen of claim 1, wherein the springboard is supported by spring loaded pins, the springboard in a raised position such that the spring loaded pins are below the springboard, thereby dropping away for loading the garment on the shirt-board, and the spring loaded pins contacting the shirtboard in a lowered position to sup-port compression of the shirtboard during a heat pressing of the printing operation.

3. The platen of claim 2, further comprising openings through the springboard to receive the spring loaded pins therethrough in the lowered position.

4. The platen of claim 1, further comprising a tag printing cut-out in the shirtboard.

5. A heat pressable platen comprising:

a shirtboard; and a springboard coupled to the shirtboard;

at least one support positioned below the springboard to provide unobstructed threading of a garment on the shirtboard, at least one portion of the at least one support moving through the springboard until the at least one portion of the least one support contacts the shirtboard during a heat pressing operation.

6. The platen of claim 5, wherein the shirtboard is cantilevered.

7. The platen of claim 5, wherein the at least one support includes spring loaded pins configured to drop away for loading the garment on the shirtboard, while supporting the shirtboard during the heat pressing operation.

8. The platen of claim 5, further comprising a tag printing cut-out in the shirtboard.

9. The platen of claim 5, further comprising at least one opening through the springboard to receive the at least one support therethrough.

10. The platen of claim 5, wherein the springboard is positioned between the shirtboard and a backing.

11. The platen of claim 10, wherein the springboard is coupled to the shirtboard at a fixed distance.

* * * * *